United States Patent [19]

Hagiwara et al.

[11] Patent Number: 4,806,179

[45] Date of Patent: Feb. 21, 1989

[54] FINE AMORPHOUS METAL WIRE

[75] Inventors: Michiaki Hagiwara; Akira Menjiu; Nomura Kohachi; Kataoka Masaru; Yamada Yoshinao; Sasaki Miyuri, all of Kyoto, Japan

[73] Assignee: Unitika Ltd., Hyogo, Japan

[21] Appl. No.: 71,823

[22] Filed: Jul. 10, 1987

[30] Foreign Application Priority Data

Jul. 11, 1986 [JP] Japan ..... 61-164310
May 27, 1987 [JP] Japan ..... 62-130870

[51] Int. Cl.[4] ..... C22C 19/07
[52] U.S. Cl. ..... 148/403
[58] Field of Search ..... 148/403

[56] References Cited

U.S. PATENT DOCUMENTS

| | | | |
|---|---|---|---|
| 4,473,401 | 9/1984 | Masumoto et al. | 148/403 |
| 4,495,691 | 1/1985 | Masumoto et al. | 148/403 |
| 4,503,085 | 3/1985 | Dickson et al. | 148/403 |
| 4,607,683 | 8/1986 | Hamashima et al. | 164/463 |
| 4,614,221 | 9/1986 | Masumoto et al. | 164/462 |

FOREIGN PATENT DOCUMENTS

| | | | |
|---|---|---|---|
| 0050479 | 4/1982 | European Pat. Off. | 148/403 |
| 0147937 | 7/1985 | European Pat. Off. | 148/403 |

*Primary Examiner*—L. Dewayne Rutledge
*Assistant Examiner*—David W. Schumaker
*Attorney, Agent, or Firm*—Sughrue, Mion, Zinn, Macpeak & Seas

[57] ABSTRACT

A fine amorphous metal wire with a circular cross section that has improved toughness and a composition represented by the formula:

$$Fe_aCo_bCr_cSi_xB_y$$

wherein a+b is from about 53 to 80 atomic %;
c is from about 3 to 20 atomic %;
x is from about 5 to 15 atomic %; and
y is from about 5 to 15 atomic %;

provided that $$\frac{(b)}{(a+b)}$$

is in a range from about $c \times 0.025 + 0.25$ to $c \times 0.012 + 0.73$; and $x+y$ is from about 17 to 27 atomic %. Having improved toughness, this fine amorphous metal wire can be drawn or otherwise worked efficiently on an industrial scale with minimum breakage. In addition, this wire has good fatigue characteristics and high corrosion resistance, as well as high tensile breaking strengths, high heat resistance and superior electromagnetic performance. Therefore, the wire is very useful in a broad range of applications including a variety of mechanical members, industrial reinforcements, and electromagnetic materials.

14 Claims, 1 Drawing Sheet

FINE AMORPHOUS METAL WIRE

FIELD OF THE INVENTION

The present invention relates to a fine amorphous metal wire with a circular cross section that has high toughness along with good fatigue characteristics and strong corrosion resistance.

BACKGROUND OF THE INVENTION

Amorphous metal materials have good electromagnetic and mechanical characteristics and studies have been conducted to commercialize various types of amorphous materials. Iron-base amorphous metals in the form of fine wires having a circular cross section are disclosed in Japanese Patent Application (OPI) No. 165016/1981 (the term "OPI" as used herein means an "unexamined published Japanese patent application") corresponding to U.S. Pat. No. 4,523,626. Japanese Patent Application (OPI) No. 213857/1983 (corresponding to U.S. Pat. No. 4,473,401) describes an iron-base amorphous alloy having improved fatigue characteristics, and Japanese Patent Application (OPI) No. 106949/1985 (corresponding to U.S. Pat. No. 4,584,034) proposes an iron-base amorphous alloy that is improved in both fatigue characteristics and toughness. The last-mentioned amorphous alloy is so much improved in cold workability that a number of wires of such an alloy can be twisted together to form a strand.

Iron-base amorphous alloys having improved corrosion resistance are described in Japanese Patent Application (OPI) Nos. 193248/1984 and 13056/1984 but no proposal has been made respecting fine wires of amorphous metals having improved corrosion resistance and toughness.

Fine amorphous metal wires are frequently used after being subjected to various types of working such as drawing to a suitable diameter, or the twisting, weaving or knitting of drawn or undrawn wires. For successful working, fine wires of amorphous metal must have not only good fatigue characteristics or corrosion resistance but also high toughness. Fine metal wires having poor toughness will break during working operations. When conventional fine metal wires are drawn through a diamond die, the number of breaks that occurs is from a few to as many as several tens per initial length of 2,000 m. Not only does this result in a short drawn wire of low commercial value, but also the efficiency of the drawing operation is reduced. The same incidence of wire breakage also occurs during working under stress such as twisting, weaving or knitting.

SUMMARY OF THE INVENTION

An object, therefore, of the present invention is to provide an amorphous metal in a fine wire with a circular cross section that has high toughness along with good fatigue characteristics and strong corrosion resistance.

As a result of intensive studies made to attain this and other objects of the present invention, the present inventors have found that they can be attained by incorporating a specified amount of Co in an alloy having a specified Fe—Cr—Si—B composition and that the obtained fine wire seldom breaks during working. The present invention has been accomplished on the basis of these findings.

Accordingly, the present invention relates to a fine wire, with a circular cross section, of an amorphous metal having improved toughness and a composition represented by the formula:

$$Fe_aCo_bCr_cSi_xB_y$$

wherein a+b is from about 53 to 80 atomic %;
c is from about 3 to 20 atomic %;
x is from about 5 to 15 atomic %; and
y is from about 5 to 15 atomic %;

provided that $$\frac{(b)}{(a+b)}$$

is in a range from about $c\times0.025+0.25$ to $c\times0.012+0.73$; and $x+y$ is from about 17 27 atomic %.

The amorphous metal in fine wire form of the present ivention exhibits high toughness along with good fatigue characteristics and strong corrosion resistance, and it yet possesses the inherent superior characteristics of an amorphous metal in fine wire form, namely high tensile breaking strength, high heat resistance and good electromagnetic performance. Therefore, it can be used in a broad range of applications including control cables, wire saws, precision springs, fishing lines and wires for electrical discharge machining, reinforcements in rubber and plastic products such as belts and tires, composites with concrete, glass, and other matrices, various industrial reinforcements, knitted and woven products such as fine mesh filters, and electromagnetic devices such as electromagnetic filters and sensors.

DETAILED DESCRIPTION OF THE INVENTION

Figure 1:
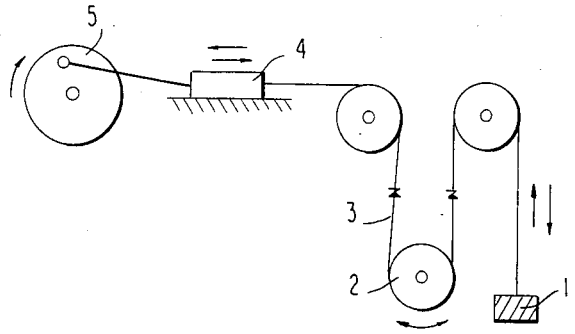
FIG. 1 is a schematic view of a deflection type fatigue tester for determining the fatigue characteristics of the fine amorphous metal wire of the present invention.

The amorphous metal in fine wire form of the present invention has improved toughness in addition to good fatigue characteristics and strong corrosion resistance. The particular alloy composition necessary to provide these desirable characteristics in a metal is now described in greater detail.

For improved toughness, the total amount of Fe and Co in the composition must be at least about 53 atomic % and not more than about 80 atomic %, and the Cr content must be at least about 3 atomic % and not more than about 20 atomic %, with the individual contents of Fe, Co and Cr satisfying the relation that $b/(a+b)$ is in a range of from about $0.025c+0.25$ to $0.012c+0.73$ (in which a=the atomic % of Fe present; b the atomic % of Co present; and c=the atomic % of Cr present). Preferably, the total Fe and Co content is at least about 57 atomic % and not more than about 76 atomic % and the Cr content is at least about 5 atomic % and not more than about 18 atomic %, with the individual contents of Fe, Co and Cr satisfying the relation that $b/(a+b)$is in a range of from about $0.025c+0.27$ to $0.012c+0.68$.

The fatigue characteristics of an amorphous metal are rapidly improved as about 3 atomic % or more of Cr is added, and substantially level off as about 10 atomic % or more of Cr is added. The corrosion resistance of the metal is gradually improved with increasing Cr content, and if the amount of Cr is less than about 10 atomic %, the corrosion resistance of the metal will be not yet sufficient under such severe conditions as in 1N HCl, $H_2SO_4$, $HNO_3$ or sea water, but the limited satisfactory improvement in corrosion resistance can be obtained. If Cr is added in an amount of about 10 atomic % or more, the metal will exhibit corrosion resistance comparable to or greater than that of SUS 304 (a most frequently employed corrosion resistant material). However, if the addition of Cr is greater than about 20 atomic %, the amorphous glass forming ability of the metal, even if it contains an optimum amount of Co, will be significantly reduced and a fine wire of amorphous metal having improved toughness cannot be attained. Therefore, in order to maintain high toughness, while adding Cr to improve fatigue characteristics or corrosion resistance, it is important that Fe and Co be added in proportions that correspond to the Cr level. In other words, the ratio of Co to Fe added must be low when the amount of Cr is small, and the relative amount of Co present is increased as more Cr is added. For the particular purpose of providing improved toughness while retaining good fatigue characteristics, the Cr content is preferably in the range of about 3 to 12 atomic %, more preferably in the range of about 5 to 10 atomic %, with corresponding Fe content being preferably in the range of about 20 to 40 atomic %, more preferably from about 25 to 35 atomic %, and the corresponding Co content being preferably in the range of about 30 to 60 atomic %, more preferably from about 35 to 55 atomic %.

Each of the Si and B contents of the amorphous metal of the present invention must be at least about 5 atomic % and not more than about 15 atomic %, preferably at least about 7 atomic % and not more than about 15 atomic %. It is also required that the total amount of Si and B be at least about 17 atomic % and not more than about 27 atomic %, with the range of about 19 to 25 atomic being preferred.

For attaining various specific purposes, the amorphous metal composition of the present invention having the above-defined Fe—Co—Cr—Si—B system may incorporate various elements. For improvement in corrosion resistance, not more than about 30 atomic %, preferably about 0.1 to 30 atomic %, of Ni and/or not more than about 10 atomic %, preferably about 0.1 to 10 atomic % of at least one of Ti, Al and Cu may be added. To improve heat resistance, corrosion resistance and mechanical characteristics, not more than about 10 atomic % preferably about 0.1 to 10 atomic %, of at least one of Ta, Nb, Mo and W may be added. For providing improved heat resistance and mechanical characteristics, not more than about 10 atomic %, preferably about 0.1 to 10 atomic % of at least one of V, Mn and Zr may be added. Furthermore, for the purpose of attaining improved amorphous forming ability, strength and fatigue characteristics, not more than about 2 atomic %, preferably about 0.1 to 2 atomic %, of C may be added. Among these elements, at least one of Ni and Mo is preferably added in respective amounts of about 1 to 20 atomic % and about 0.5 to 5 atomic %, for the specific purpose of providing improved corrosion resistance.

While the fine wire of the present invention can be produced from the alloy composition specified above, it is most preferable to quench and solidify the alloy by spinning in a rotating liquid pool according to the method described in Japanese Patent Application (OPI) No. 165016/1981 (corresponding to U.S. Pat. No. 4,523,626). In this method, a drum containing water is rotated at high speed to form a water film on the inner surface of the drum by centrifugal force, and a molten alloy is injected into the water film through a spinning nozzle with a diameter of about 80 to 200 μm, thereby forming fine wires with a circular cross section. In order to prepare a fine continuous wire of consistent quality, it is desired that the peripheral speed of the rotating drum be equal to or greater than the velocity of the stream of molten metal being injected from the spinning nozzle, with the case where the former is about 5 to 30% faster than the latter being particularly preferred. It is also preferred that the stream of molten metal being injected from the spinning nozzle form an angle of at least about 20° with the water film formed on the inner surface of the rotating drum.

Another preferred method for making the fine wire of the present invention is shown in Japanese Patent Application (OPI) No. 173059/1983 (corresponding to U.S. Pat. No. 4,607,683). According to this method, a molten alloy having the specified composition is injected through a spinning nozzle (diameter about 80 to 200 μm) into a cooling liquid layer on a running grooved conveyor belt, thereby forming a fine wire having a circular cross section.

The fine wire of the present invention has a diameter of about 50 to 250 μm and is uniform in shape with a roundness of at least about 60%, preferably at least about 80%, more preferably at least about 90%, and an unevenness in diameter of not more than about 4%.

Figure 2:
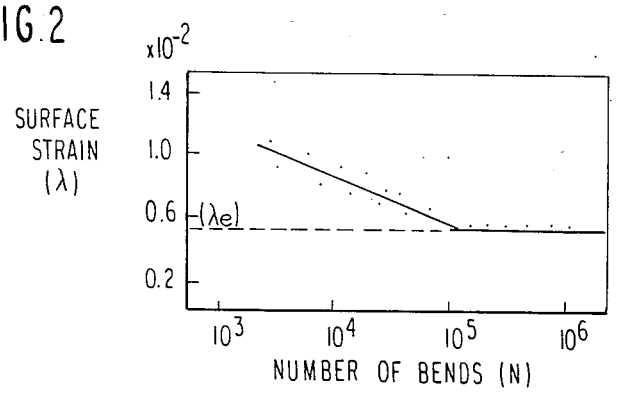
FIG. 2 is a graph showing the λ-N curve obtained for various alloy samples by measurement with the apparatus of FIG. 1.

The advantages of the present invention will be made even more apparent by the following examples and comparative examples which are for the purposes of illustration and are not to be construed as limitting the scope of the present invention. The samples prepared in the examples were checked for their tensile breaking strength, fatigue characteristics, corrosion resistance, toughness and shape by the following test methods. (1) Fatigue limit (λe): The specimen was set in a conventional deflection type fatigue tester as illustrated in FIG. 1 capable of affording cyclic bending in one direction. The tester comprised a weight 1 for applying a given load (4 kg) per unit cross-sectional area (1 $mm^2$), a pulley 2 for adjusting the surface strain (λ) of the specimen 3, a horizontally moving slider 4 and a rotary disk 5. At a constant bending cycle (N) of 100 bends/min, the pulley diameter was varied to adjust the surface strain (λ) of the specimen under a predetermined load W (4 kg/mmz). As a result, a λ-N curve as shown in FIG. 2 was obtained, in which λ and N were plotted on the vertical and horizontal axes, respectively. The surface strain at which the curve became flat was taken as the fatigue limit (λe) of the specimen. The formula used to calculate λ was:

$$\lambda = \frac{t}{2r}$$

where t is the diameter of the specimen and r is the radius of the pulley. The above-described evaluation test was carried out at 20° C. and 65% relative humidity (r.h.) in accordance with a test method as described in U.S. Pat. Nos. 4,473,401 and 4,584,034.

(2) Corrosion resistance: Corrosion resistance evaluation was conducted by the weight loss method, in which the specimen was immersed in 1N HCl, $H_2SO_4$ or $HNO_3$ at 20° C. for 8 hours and the residual weight (%) of the sample was measured by the following formula:

$$\text{Residual weight (\%)} = \frac{\omega}{\omega_o} \times 100$$

where $\omega_0$ is the weight of the specimen before treatment and $\omega$ is the weight of the specimen after treatment.

(3) Tensile breaking strength: The tensile breaking strength of the specimen was determined from the S—S curve (stress-strain curve) obtained by measurement with an Instron tensile tester (specimen length, 12 cm; distortion speed, $4.17\times10^{-4}$/sec) in accordance with a test method as described in U.S. Pat. No. 4,495,691.

Figure 3:
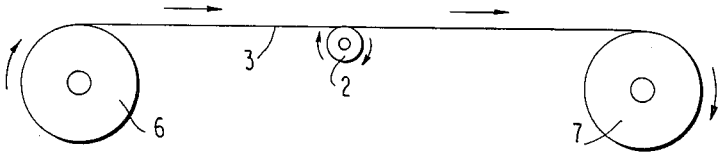
FIG. 3 is a schematic view of a tester used for toughness measurements.

(4) Toughness index (i) (number of breaks/2,000 m): A fine metal wire (specimen 3 in FIG. 3) wound around a pulley 2 by one turn (pulley diameter was adjusted in accordance with the wire diameter so that 2.2% surface strain would be exerted on the wire) was continuously fed from a delivery roller 6 and wound up by a takeup roller 7 with a back stress (40 kg/mm$^2$) being exerted on the running specimen 3. The toughness of the specimen was evaluated by counting the number of breaks that occurred in the wire per initial length of 2,000 m. The surface strain on the fine wire was calculated by the same formula as used in the fatigue test (1). Toughness index (i) serves as a measure of the ability to withstand operations under stress such as twisting, weaving and knitting.

(5) Toughness index (ii) (number of breaks/2,000 m): A fine amorphous metal wire with a diameter of 0.130 mm was drawn to 0.10 mm diameter at a speed of 100 m/min in a drawing machine in which the wire was passed through 11 series-arranged diamond diès ranging in nozzle hole diameter from 0.150 mm to 0.100 mm at a pitch of 0.005 mm. The toughness of the specimen was evaluated by counting the number of breaks that occurred in the wire per initial length of 2,000 m. Toughness index (ii) serves as a measure of the ability to withstand drawing operations.

(6) Shape: The roundness of the specimen was evaluated in terms of the following ratio of $R_{max}$ to $R_{min}$, $R_{max}$ being the diameter across the longest axis and $R_{min}$ being the diameter across the shortest axis for the same cross section, in accordance with a test method as described in U.S. Pat. Nos. 4,523,626 and 4,527,614.

$$\text{Roundness (\%)} = \frac{R\text{min}}{R\text{max}} \times 100$$

Unevenness in thickness in the longitudinal direction was evaluated on the basis of diameter measurement at 10 randomly selected points in a 10-m long portion of the specimen; the difference between the maximum and minimum diameters was divided by the average diameter and the quotient was multiplied by 100.

EXAMPLES 1 to 14 AND COMPARATIVE EXAMPLES 1 to 13

Alloy samples having the compositions listed in Table 1 were melted in an argon atmosphere and injected through a ruby spinning nozzle (nozzle hole diameter 0.135 mm at a controlled argon pressure of 4.5 kg/cm$^2$ into a rotating cooling liquid (4° C., 3.0 cm deep) that was formed on the inner surface of a cylindrical drum (inner diameter, 600 mm) rotating at 320 rpm. The melts were cooled rapidly into uniform and continuous fine amorphous metal wires having a circular cross section with an average diameter of 0.13 mm.

The tip of the spinning nozzle was held away from the surface of the rotating cooling liquid at a distance of 1 mm, and the stream of molten metal being injected from the nozzle formed an angle of 70° with the surface of the rotating cooling liquid.

The pressure of the carrier argon gas was so adjusted that the velocity of the molten stream injected from the nozzle, which was calculated from the weight of metal collected by injection into the atmosphere for a given time, would be about 570 m/min.

The tensile breaking strength, fatigue characteristics and toughness indices of each amorphous metal wire sample were determined by measurement at 20° C. and 65% relative humidity (r.h.), and the data obtained are shown in Table 1. The corrosion resistance of representative samples was measured by the weight loss method (including immersion in 1N HCl, $H_2SO_4$ or $HNO_3$ at 20° C. for 8 hours) and the results are shown in Table 2. For the sake of comparison, the corrosion resistance of a SUS 304 wire (130 μm diameter), SUS 304 being a commonly employed corroion-resistant wire material, was also evaluated using SUS 304M manufactured by Fuji Densen Denki KK in the same procedure and the results are shown in Table 2. The SUS 304M was a SUS 304 wire (wire diameter: 130 μm and strength: 235 kg/mm$^2$) having an alloy composition of not more than 0.08 wt % C, 19 wt % Cr, 9 wt % Ni, not more than 1.0 wt % Si, not more than 2.0 wt % Mn and the balance being Fe.

TABLE 1

| Example No. | Alloy Composition (atom %) | Tensile Breaking Strength (kg/mm$^2$) | Fatigue Limit ($\lambda e \times 10^2$) | Toughness Index (i) (no. of breaks/2,000 m) | Toughness Index (ii) (no. of breaks/2,000 m) | Shape | |
|---|---|---|---|---|---|---|---|
| | | | | | | Roundness (%) | Unevenness in Thickness (%) |
| Comparative Example 1 | $Fe_{75}Si_{10}B_{15}$ | 320 | 0.35 | ≧100 | ≧100 | 96 | 1.3 |
| Comparative Example 2 | $Fe_{70}Cr_5Si_{15}B_{10}$ | 326 | 0.80 | 40 | 20 | 97 | 1.1 |
| Comparative Example 3 | $Fe_{68}Cr_7Si_{15}B_{10}$ | 330 | 1.15 | 90 | 50 | 97 | 1.2 |
| Example 1 | $Fe_{37}Co_{37}Cr_4Si_{10}B_{12}$ | 328 | 0.50 | 1 | 1 | 97 | 1.1 |
| Example 2 | $Fe_{35}Co_{36}Cr_7Si_{10}B_{12}$ | 330 | 1.00 | 0 | 0 | 98 | 1.0 |
| Example 3 | $Fe_{34}Co_{35}Cr_9Si_{10}B_{12}$ | 330 | 1.20 | 2 | 2 | 97 | 1.1 |
| Example 4 | $Fe_{31}Co_{40}Cr_7Si_9B_{13}$ | 330 | 1.00 | 0 | 0 | 98 | 1.0 |
| Example 5 | $Fe_{25}Co_{45}Cr_7Si_9B_{13}$ | 325 | 0.90 | 2 | 1 | 97 | 1.1 |
| Example 6 | $Fe_{16}Co_{49.5}Cr_{12.5}Si_9B_{13}$ | 332 | 1.28 | 0 | 0 | 98 | 1.1 |

TABLE 1-continued

| Example No. | Alloy Composition (atom %) | Tensile Breaking Strength (kg/mm$^2$) | Fatigue Limit ($\lambda e \times 10^2$) | Toughness Index (i) (no. of breaks/2,000 m) | Toughness Index (ii) (no. of breaks/2,000 m) | Shape Roundness (%) | Shape Unevenness in Thickness (%) |
|---|---|---|---|---|---|---|---|
| Example 7 | $Fe_{14}Co_{49}Cr_{15}Si_9B_{13}$ | 335 | 1.30 | 2 | 1 | 97 | 1.2 |
| Example 8 | $Fe_{10}Co_{50}Cr_{18}Si_9B_{13}$ | 338 | 1.30 | 3 | 2 | 96 | 1.2 |
| Comparative Example 4 | $Fe_6Co_{65}Cr_7Si_9B_{13}$ | 326 | 0.80 | 20 | 20 | 95 | 1.3 |
| Comparative Example 5 | $Fe_{60}Co_{11}Cr_7Si_9B_{13}$ | 323 | 0.85 | 70 | 40 | 97 | 1.2 |
| Comparative Example 6 | $Fe_{50}Co_{20}Cr_5Si_{10}B_{15}$ | 326 | 0.45 | 65 | 35 | 92 | 1.4 |
| Comparative Example 7 | $Fe_{38}Co_{38}Cr_2Si_{10}B_{12}$ | 320 | 0.35 | ≧100 | ≧100 | 97 | 1.1 |
| Comparative Example 8 | $Fe_{30}Co_{34}Cr_{14}Si_{10}B_{12}$ | 310 | 1.30 | ≧100 | ≧100 | 96 | 1.1 |
| Comparative Example 9 | $Fe_7Co_{47}Cr_{23}Si_{10}B_{13}$ | 340 | 1.30 | 85 | 70 | 96 | 1.3 |
| Example 9 | $Fe_{34}Co_{34}Cr_7Si_{13}B_{12}$ | 328 | 1.10 | 2 | 1 | 97 | 1.1 |
| Example 10 | $Fe_{31}Co_{40}Cr_7Si_{7.5}B_{14.5}$ | 335 | 1.00 | 3 | 1 | 97 | 1.1 |
| Comparative Example 10 | $Fe_{36}Co_{37}Cr_7Si_4B_{16}$ | No continuous fine metal wire could be formed. | | | | | |
| Comparative Example 11 | $Fe_{33}Co_{33}Cr_7Si_{17}B_{10}$ | | | | | | |
| Comparative Example 12 | $Fe_{30}Co_{30}Cr_7Si_{15}B_{18}$ | | | | | | |
| Comparative Example 13 | $Fe_{33}Co_{33}Cr_7Si_{14}B_3$ | | | | | | |
| Comparative Example 14 | $Fe_{33}Co_{34}Cr_7Si_9B_{17}$ | 330 | 1.00 | ≧100 | ≧100 | 96 | 1.3 |
| Example 11 | $Fe_{31}Co_{40}Cr_5Mo_2Si_{10}B_{12}$ | 335 | 1.20 | 2 | 2 | 97 | 1.1 |
| Example 12 | $Fe_{27}Co_{40}Cr_9Mo_2Si_{10}B_{12}$ | 337 | 1.20 | 1 | 1 | 97 | 1.2 |
| Example 13 | $Fe_{16}Co_{47.5}Cr_{12.5}Mo_2Si_9B_{13}$ | 338 | 1.32 | 1 | 1 | 97 | 1.2 |
| Example 14 | $Fe_{31}Co_{30}Ni_{10}Cr_7Si_{10}B_{12}$ | 315 | 1.00 | 2 | 2 | 97 | 1.1 |

TABLE 2

| Sample | Residual Weight (%) 1NHCl | 1NH$_2$SO$_4$ | 1NHNO$_3$ |
|---|---|---|---|
| Comparative Example 1 | 85 | 83 | 0 |
| Example 1 | 88 | 87 | 0 |
| Example 2 | 90 | 90 | 55 |
| Example 3 | 93 | 92 | 95 |
| Example 6 | 95 | 97 | 100 |
| Example 7 | 96 | 100 | 100 |
| Example 8 | 97 | 100 | 100 |
| Example 12 | 98 | 99 | 100 |
| Example 13 | 100 | 100 | 100 |
| Example 14 | 95 | 92 | 70 |
| SUS 304 | 92 | 96 | 98 |

Tables 1 and 2 show that the sample prepared in Comparative Example 1 which contained no Cr was low in fatigue characteristics and corrosion resistance with unsatisfactory toughness. The samples prepared in Comparative Examples 2 and 3 also locked satisfactory toughness because of the absence of Co.

The sample prepared in Comparative Example 4 contained too much Co, and hence too little Fe in consideration of the Cr content, failing to satisfy the relation $0.025c+0.25 \leqq b/(a+b) \leqq 0.0121c+0.73$ (since a=6, b=65 and c=7, $b/(a+b)=0.92$ and $0.0121c+0.073=0.81$, which does not satisfy the above relation) and its toughness was unsatisfactory. In contrast, the samples prepared in Comparative Examples 5, 6 and 8 contained too much Fe and hence too little Co in consideration of the Cr content, also failing to satisfy the relation $0.025c+0.25 \leqq b/(a+b) \leqq 0.0121c+0.73$ (in Comparative Example 5, a=60, b=11 and c=7, so $0.025c\ 0.25=0.43$ and $b/(a+b)=0.15$, and Comparative Example 6, a=50, b=20 and c=5, so $0.025c+0.25=0.38$ and $b/(a+b)=0.29$, and in Comparative Example 8, a =30, b=34 and c=14, so $0.025c+0.25=0.60$ and $b/(a+b)=0.53$; in either c satisfied) and the toughness of these samples was unsatisfactory. The sample prepared in Comparative Example 7 contained too small an amount of Cr to provide satisfactory fatigue characteristics and toughness. On the other hand, the sample prepared in Comparative Example 9 contained too large an amount of Cr to furnish satisfactory toughness.

No continuous (ca. 2,000 m long) fine metal wire could be formed in Comparative Example 10, 11, 12 or 13, which were outside the invention composition, for the following reasons: the alloy composition used in Comparative Example 10 contained too small an amount of Si, the alloy composition used in Comparative Example 11 contained too large an amount of Si, the alloy composition used in Comparative Example 12 contained too much Si and B in combination, and the ally composition used in Comparative Example 13 contained too less B. The wire sample prepared in Comparative Example 14 which contained too much B had no satisfactory toughness.

As compared with these samples, those prepared in Examples 1 to 14 obviously had superior toughness. As is clear from Tables 1 and 2, the fatigue limit and corrosion resistance of the samples of the present invention had a tendency to increase with the Cr content. However, the fatigue limit was almost reached at a Cr content of about 9 atomic % ($\lambda e=1.20$ in Example 3), and even when more Cr was added the resulting improvement in fatigue limit was not as great as expected ($\lambda e=1.30$ in Example 8 where Cr was incorporated in an amount of 18 atomic %).

Limited satisfactory improvement in corrosion resistance could be attained when Cr was incorporated in an amount of about 7 atomic % (as in Example 2) and corrosion resistance better than that of SUS 304 was obtained by combining 9 atomic % Cr with 2 atomic % Mo (as in Example 12) or by incorporating at least 12.5 atomic % Cr (as in Example 6). In Example 13, in which 12.5 atomic Cr was used in combination with 2 atomic % Mo, a fine amorphous metal wire having excellent corrosion resistance was produced.

It was therefore clear that at least about 10 atomic % Cr must be incorporated in order to attain excellent fatigue characteristics and high corrosion resistance at the same time.

Seven of the thin amorphous metallic wires prepared in Example 4 were stranded with a planetary twisting machine to make a 1,000-m long cord at a speed of 50 cm/min with no breaking occurring during the twisting operation. The number of twists in the cord was 195 turns per meter. On the other hand, when the wires prepared in Comparative Examples 1 and 3 were stranded under the same conditions as described above, 47 breaks and 32 breaks occurred in the wire per length of 1,000 m during the twisting operation to provide a feasible cord, respectively.

While the invention has been described in detail and with reference to specific embodiments thereof, it will be apparent to one skilled in the art that various changes and modifications can be made therein without departing from the spirit and scope thereof.

What is claimed is:

1. A fine amorphous metal wire with a circular cross section having improved toughness comprising an amorphous metal having a composition represented by the formula:

$$Fe_aCo_bCr_cSi_xB_y$$

wherein a+b is from about 53 to 80 atomic %;

c is from about 3 to 20 atomic %;

x is from about 5 to 15 atomic %; and y is from about 5 to 15 atomic %;

provided that $$\frac{(b)}{(a+b)}$$

is in a range from about c×0.025 +0.25 to c×0.0121+0.73; and x+y is from about 17 to 27 atomic %.

2. A fine amorpous metal wire as claimed in claim 1, wherein a+b is from about 57 to 76 atomic % and c is from about 5 to 18 atomic %, provided that $$\frac{(b)}{(a+b)}$$

is in a range from about c×0.025+0.27 to c×0.0121+0.68.

3. A fine amorpous metal wire as claimed in claim 1, wherein a is from about 20 to 40 atomic %, b is from about 30 to 60 atomic %, and c is from about 3 to 12 atomic %.

4. A fine amorpous metal wire as claimed in claim 3, wherein a is from about 25 to 35 atomic %, b is from about 35 to 55 atomic %, and c is from about 5 to 10 atomic %.

5. A fine amouous metal wire as claimed in claim 1, wherein x is from about 7 to 15 atomic %, y is from about 7 to 15 atomic %, and x+y is from about 19 to 25 atomic %.

6. The fine amorphous metal wire as claimed in claim 1, further comprising at least one metal selected from the group consisting of Ni, Ti, Al, and Cu, provided that Ni is not used in an amount of more than about 30 atomic % and any one metal selected from the group consisting of Ti, Al, Cu is not used in amount of more than about 10 atomic %.

7. A fine amorphous metal wire as claimed in claim 6, comprising from about 0.1 to 30 atomic % of Ni and/or from about 0.1 to 10 atomic % of at least one selected from the group consisting of Ti, Al and Cu.

8. A fine amorphous metal wire as claimed in claim 1, further comprising from about 0.1 to 10 atomic % of at least one selected from the group consisting of Ta, Nb, Mo and W.

9. A fine amorphous metal wire as claimed in claim 1, further comprising from about 0.1 to 10 atomic % of at least one selected from the group consisting of V, Mn and Zr.

10. A fine amorphous metal wire as claimed in claim 1, further comprising from about 0.1 to 2 atomic % of carbon.

11. A fine amorphous metal wire as claimed in claim 1, further comprising from about 1 to 20 atomic % of Ni and/or from about 0.5 to 5 atomic % of Mo.

12. A fine amorphous metal wire as claimed in claim 1, wherein the diameter of said wire is from about 50 to 250 μm, the roundness of said wire is at least about 60% and the unevenness in diameter of said wire is not more than about 4%.

13. A fine amorphous metal wire as claimed in claim 12, having a roundness of at least about 80%.

14. A fine amorphous metal wire as claimd in claim 13, having a roundness of at least about 90%.

* * * * *